United States Patent [19]

Knop et al.

[11] Patent Number: 4,626,863

[45] Date of Patent: Dec. 2, 1986

[54] LOW SIDE LOBE GREGORIAN ANTENNA

[75] Inventors: Charles M. Knop, Lockport; Edward L. Ostertag, New Lenox; Yuk-Bun Cheng, Lockport, all of Ill.

[73] Assignee: Andrew Corporation, Orland Park, Ill.

[21] Appl. No.: 531,069

[22] Filed: Sep. 12, 1983

[51] Int. Cl.[4] ..... H01Q 19/19

[52] U.S. Cl. ..... 343/781 P; 343/838

[58] Field of Search ..... 343/781 R, 781 P, 781 CA, 343/782, 783, 785, 786, 840, 912, 18 A, 838

[56] References Cited

U.S. PATENT DOCUMENTS

| | | | |
|---|---|---|---|
| 3,176,301 | 3/1965 | Wellons et al. | 343/782 |
| 3,314,071 | 4/1967 | Lader et al. | 343/912 |
| 3,662,393 | 5/1972 | Cohn | 343/786 |
| 4,096,483 | 6/1978 | Bui Hai et al. | 343/781 CA |
| 4,263,599 | 4/1981 | Bielli et al. | 343/781 R |

FOREIGN PATENT DOCUMENTS

| | | | |
|---|---|---|---|
| 1048298 | 1/1959 | Fed. Rep. of Germany | 343/840 |
| 1296221 | 5/1969 | Fed. Rep. of Germany | 343/781 CA |
| 2319731 | 4/1973 | Fed. Rep. of Germany | 343/781 CA |

OTHER PUBLICATIONS

Burdine et al, "A Low Side Lobe Earth Station Antenna for the 4/6 GHz Band," Microwave Journal, Nov. 1980, pp. 53–58.

*Primary Examiner*—Eli Lieberman
*Assistant Examiner*—Michael C. Wimer
*Attorney, Agent, or Firm*—Leydig, Voit & Mayer

[57] ABSTRACT

A microwave antenna comprising the combination of a paraboloidal main reflector; a subreflector located such that the paraboloidal main reflector and the subreflector have a common focal point lying between the main reflector and the subreflector; a feed horn for transmitting microwave radiation (preferably symmetrically) to, and receiving microwave radiation from, said subreflector; and a shield connected to the peripheral portion of the subreflector and having an absorbing surface which reduces side lobe levels both by capturing the feed horn spillover energy and by reducing the diffraction of microwave radiation from the edge of the subreflector. The shield is preferably formed as a continuous axial projection extending from the periphery of the subreflector toward the main reflector substantially parallel to the axis of the feed horn. The reflective surface of the subreflector is suitably a section of an approximate ellipse.

5 Claims, 12 Drawing Figures

3.95 GHz WITH DUAL MODE FEED HORN 6.175 GHz WITH DUAL MODE FEED HORN 3.95 GHZ WITH DUAL MODE FEED HORN 6.175 GHZ WITH DUAL MODE FEED HORN 3.95 GHz WITH FLARED CORRUGATED FEED HORN 6.175 GHz WITH FLARED CORRUGATED FEED HORN 3.95 GHz WITH FLARED CORRUGATED FEED HORN 6.175 GHz WITH FLARED CORRUGATED FEED HORN

LOW SIDE LOBE GREGORIAN ANTENNA

FIELD OF THE INVENTION

The present invention relates generally to microwave antennas and, more particularly, to dual-reflector microwave antennas.

BACKGROUND OF THE INVENTION

Dual-reflector microwave antennas are known which minimize signal blockage at the main reflector dish aperture by utilizing small-diameter feed horns and subreflectors. These small-diameter feed horn and subreflector combinations produce a good radiation pattern envelope (RPE) in the near-in side lobes between 3° and 10° from the antenna axis. Unfortunately, the small-diameter feed horn characteristically displays a wide angle beam which causes an illumination pattern at the surface of the subreflector which is larger in area than the subreflector surface area. Consequently, some portion of the microwave energy fed from the small diameter feed horn spills past the periphery of the subreflector surface. The effect of energy spillover is a degradation in antenna performance in the side lobe region between 3° and 180° from the antenna axis.

SUMMARY OF THE INVENTION

It is a primary object of the present invention to provide an improved dual-reflector microwave antenna which utilizes a small-diameter feed horn and subreflector while maintaining a good RPE in the 3° to 10° range, and achieving a superior RPE in the region between the 10° and 180° range. In this connection, a related object of this invention is to provide such an improved antenna which minimizes side lobes caused by spillover and diffraction while maintaining good gain performance, and which can be efficiently and economically produced at a relatively low cost.

It is another object of this invention to provide an improved dual-reflector microwave antenna which minimizes the length of the main reflector shield placed about the periphery of the main reflector, thereby minimizing total antenna shield surface area.

Yet another object of the present invention is to provide such an improved dual-reflector microwave antenna which is capable of satisfying the latest RPE specifications set by the U.S. Federal Communications Commission for earth station antennas.

Other objects and advantages of the invention will be apparent from the following detailed description and the accompanying drawings.

In accordance with the present invention, there is provided a microwave antenna which comprises the combination of a paraboloidal main reflector; a subreflector located such that the paraboloidal main reflector and the subreflector have a common focal point lying between the main reflector and the subreflector; a feed horn for transmitting microwave radiation to, and receiving microwave radiation from, said subreflector; and a shield connected to the peripheral portion of the subreflector and having an absorbing surface which reduces side lobe levels caused by feed horn spillover energy and diffraction of microwave radiation. The shield is preferably formed as a continuous axial projection extending from the periphery of the subreflector toward the main reflector substantially parallel to the axis of the feed horn. The reflective surface of the subreflector is suitably a section of an approximate ellipse.

DESCRIPTION OF THE PREFERRED EMBODIMENT

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Figure 1:
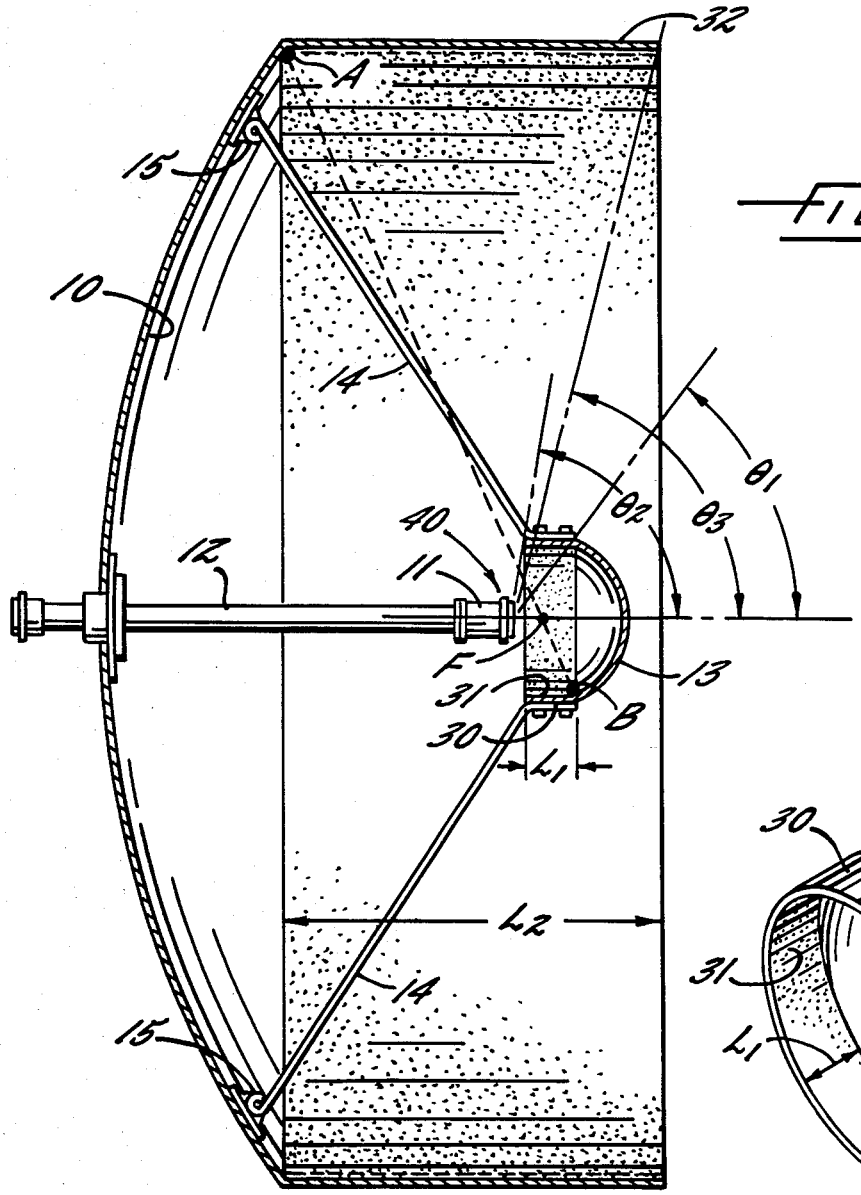
FIG. 1 is a vertical section taken through the middle of a dual-reflector microwave antenna embodying the invention.

Turning now to the drawings and referring first to FIG. 1, there is illustrated a dual-reflector antenna comprising a paraboloidal main reflector dish 10, a primary feed horn 11 connected to and supported by a circular waveguide 12 extending along the axis of the dish 10, and a subreflector 13 (the paraboloidal axis of the dish is identified as the horizontal line in FIG. 1 from which angles $\theta_1$, $\theta_2$ and $\theta_3$ are referenced). The axis of the main dish as shown in FIG. 1 is coincident with the longitudinal axis of the waveguide 12 and feed horn 11. (The term "feed" as used herein, although having an apparent implication of use in a transmitting mode, will be understood to encompass use in a receiving mode as well, as is conventional in the art.)

In the transmitting mode, the feed horn 11 receives microwave signals via the circular waveguide 12 and launches those signals onto the subreflector 13; the subreflector reflects the signals onto the main reflector dish 10, which in turn reflects the radiation in a generally planar wave across the face of the paraboloid. In the receiving mode, the paraboloidal main reflector 10 is illuminated by an incoming planar wave and reflects this energy into a spherical wave to illuminate the subreflector 13; the subreflector reflects this incoming energy into the feed horn 11 for transmission to the receiving equipment via the circular waveguide 12.

The common focal point F of the paraboloidal surface of the main reflector 10 and the reflecting surface of the subreflector 13 is located between the two reflectors to define what is commonly known as a Gregorian configuration. To achieve this configuration, the subreflector presents a concave reflective surface to the face of the main reflector. To support the subreflector 13 in this desired position, the subreflector is mounted on the end of a tripod 14 fastened to brackets 15 on the main reflector dish 10. The tripod 14 is composed of three metal support legs (usually covered with absorber material) which are relatively thin and introduce only a negligible amount of VSWR and pattern degradation into the antenna system. Normally the tripod is arranged so that the support legs are outside the horizontal plane. Alternatively, the subreflector can be supported by a dielectric cone with the small end of the cone mounted on the main reflector 10, or on the waveguide 12, and with the subreflector mounted on the large end of the cone.

The subreflector 13 is positioned and dimensioned to intercept a large portion of the radiation launched from the feed horn 11 in the transmitting mode, and an equally large portion of the incoming radiation reflected by the main reflector 10 in the receiving mode, while at the same time minimizing blockage of the aperture of the main reflector 10. The subreflector preferably has a maximum diameter of about six wavelengths at the lowband frequency and nine wavelengths at the highband and is positioned sufficiently close to the feed horn to accomplish the desired interception of radiation from the horn.

In the 3° to 10° region, relatively low side lobes result from an antenna constructed with a small subreflector since the small diameter of the subreflector reduces the obstruction of radiation to and from the main reflector surface. But the side lobes in the region beyond 10° are typically at undesirably high levels.

In accordance with an important aspect of the present invention, the subreflector 13 is fitted with an absorber-lined shield 30 which intercepts and dissipates a substantial portion of the spillover from the feed horn 11 and also reduces diffraction of microwave radiation at the periphery of the subreflector 13. For the purpose of dissipating the spillover energy intercepted by the shield 30, the inner surface of this shield is lined with an absorber material 31. Spillover radiation is intercepted and dissipated by the shield 30 which projects from the periphery of the subreflector toward the main reflector and parallel to the axis of the feed horn. Since the Gregorian configuration of the antenna utilizes a concave reflective surface on the subreflector (as contrasted with, for example, the convex reflective surface utilized in a Cassegrain configuration), the shield 30 can be added to the periphery of the subreflector 13 without interfering with the signal path between the subreflector 13 and the main reflector 10.

The axial length L1 of the shield 30 is limited by the surface of an imaginary cone whose apex is the common focal point F of the dual reflectors and whose base is the periphery of the main reflector (the cone surface is illustrated by the dotted line A–B, in FIG. 1). In three dimensions, this imaginary cone defines the surface within which the presence of the subreflector shield would interfere with the signal path between the main reflector 10 and the subreflector 13.

Diffraction normally occurs at an edge of a subreflector. However, with the addition of the subreflector shield 30, the only diffracting edge of the subreflector assembly, i.e., the edge of the shield 30, is located in a region where the spillover energy level is significantly less than at the periphery of the subreflector 13. As a consequence, the diffraction caused by the subreflector assembly with the shield 30 is much less than without the shield, producing lower side lobes in the region beyond about 10° off axis.

Referring to FIG. 1, the edge of the subreflector shield 30 is shown to be at an angle $\theta_2$ with respect to the axis of the main dish shown in FIG. 1, while the edge of the subreflector 13 is at an angle $\theta_1$ with respect to the axis of the main reflector. Since the radiation beam, as it leaves the feed horn 11, has its peak on the axis of the main reflector 10, the spillover energy level of the beam emanating from the feed horn 11 at angle $\theta_2$ is significantly lower than it is at angle $\theta_1$. Consequently, diffraction of that portion of the beam impinging on the periphery of the shield 30 (at angle $\theta_2$) contributes substantially less to the side lobe patterns than would diffraction of the beam from the edge of the subreflector 13 (at angle $\theta_1$), which corresponds to a higher energy level within the beam path. In other words, the addition of the shield 30 moves the diffracting edge of the subreflector assembly from the relatively high-energy angle $\theta_1$ to the relatively low-energy angle $\theta_2$.

To capture the spillover energy that is not intercepted by the subreflector shield 30, a shield 32 is provided on the main reflector 10. This shield 32, which has a relatively short axial length L2, is also lined with absorbing material 31. The lengths L1 and L2 of the two shields 30 and 32 are such that their combined effect is to intercept and dissipate substantially all the spillover radiation from the feed horn 11, i.e., the angle $\theta_3$ from the axis to the edge of the shield 32 is less than or equal to the angle $\theta_2$ from the axis to the edge of the shield 30. With these two shields 30 and 32, the antenna exhibits much improved RPE side lobes.

In order to minimize the size of the main reflector shield 32, the axial length L1 of the subreflector shield 30 is preferably maximized. The upper limit for the length L1 of the subreflector shield is the imaginary cone mentioned earlier, representing the outermost portion of the signal path between the two reflectors. In practice, the shield length L1 is made slightly shorter than its maximum permissible length to ensure that it does not interfere with the desired beam.

Figure 2:
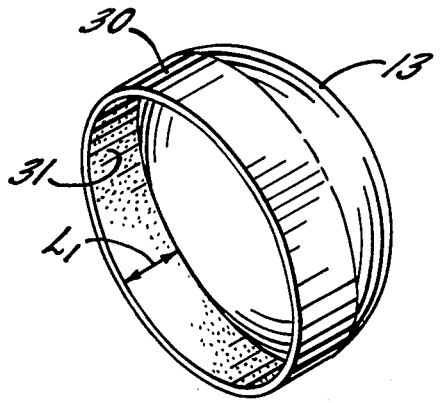
FIG. 2 is an enlarged perspective view of the subreflector portion of the antenna of FIG. 1.

Referring to FIG. 2, the shield 30 is positioned on the periphery of the subreflector 13. Any number of means for attaching the shield to the subreflector can be used, depending on the materials of construction used for the shield and subreflector. The shield is preferably constructed of a continuous flat metal or fiberglass projection in an annular shape whose inner and outer walls are substantially parallel to the axis of the subreflector. Conventional microwave absorbing material having a pyramidal, flat or convoluted surface, or even "hair" absorber, can be used on the inside surface of the shield.

The main reflector shield 32 is constructed in a manner similar to the subreflector shield 30. The shield 32 is also constructed of an annular metal or fiberglass projection whose inner and outer walls are substantially parallel to the axis of the main reflector. The inner wall is lined with microwave absorbing material which can be the same as that used in the subreflector shield 30.

Figure 3:
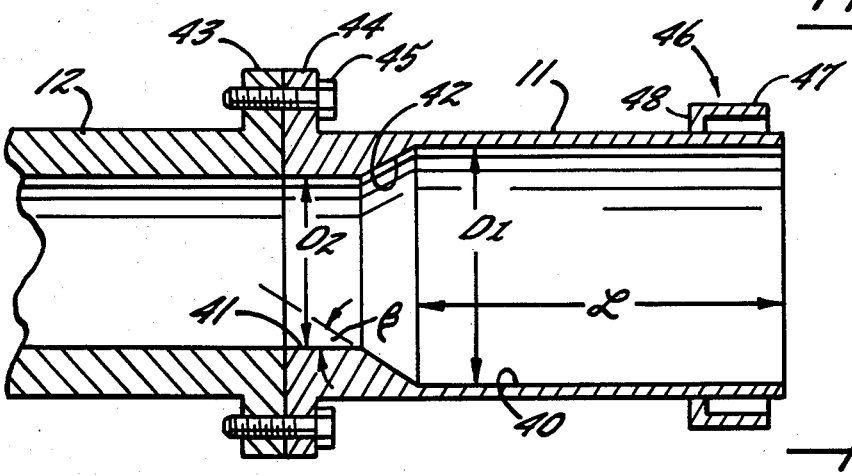
FIG. 3 is an enlarged section of the feed horn portion of the antenna of FIG. 1.

Referring next to FIG. 3, the feed horn 11 comprises two straight circular waveguide sections 40 and 41 interconnected by a conical circular waveguide section 42. This feed horn produces substantially equal E-plane and H-plane patterns in two different frequency bands. This is accomplished by selecting the diameter of the horn mouth (aperture) to be approximately equal to one wavelength in the lower frequency band, and then selecting the slope of the conical wall to cancel the radial electric field at the aperture of the horn (of inner diameter D1) in the upper frequency band. The one-wavelength diameter for the lower frequency band produces substantially equal patterns in the E and H planes for the lower-frequency signals, while the cancellation of the electric field of the higher-frequency signals at the inside wall of the horn aperture produces substantially equal patterns in the E and H planes for the higher-frequency signals. The horn is both small and inexpensive to fabricate, and yet it produces optimum main beam patterns in both the E and H planes in two different frequency bands simultaneously. The small size of the horn means that it minimizes horn blockage in reflector-type antennas, even though they are dual frequency band antennas.

The feed horn 11 is a conventional smooth-wall $TE_{11}$-mode horn at the low frequency (e.g., 3.95 GHz) with an inside diameter D1 in its larger cylindrical section 40 approximately equal to the wavelength at the center frequency (e.g., 3.95 GHz) of the lower frequency band. The second cylindrical section 41 of the feed horn has a smaller inside diameter D2, and the two cylindrical sections 40 and 41 are joined by the uniformly tapered conical section 42 to generate (at the junction of sections 40 and 42) and propagate the $TM_{11}$ mode in the upper frequency band (e.g., 6 GHz). More specifically, the conical section 42 generates (at the junction of sections 40 and 42) a $TM_{11}$ mode from the $TE_{11}$ mode propagating from left to right in the smaller cylindrical section 41. At the end of the conical section 42 the freshly generated $TM_{11}$ mode leads the $TE_{11}$ mode by about 90° in phase. The slope of the conical section 42 determines the amplitude of the $TM_{11}$ mode signal, while the length L of the larger cylindrical section 40 determines the phase relationship between the two modes at the aperture of the feed horn.

Proper selection of the length L of the cylindrical section 40 of the feed horn 11 insures that the $TM_{11}$ and $TE_{11}$ modes are in phase at the feed horn aperture, in the upper frequency band (which produces cancellation of the electric field of the wall). Also, good impedance matching is obtained, with the feed horn design of FIG. 3 having a VSWR of less than 1.1. The inside diameter of the waveguide 12 coupled to the small end of the feed horn is the same as that of the smaller cylindrical section 41. A pair of coupling flanges 43 and 44 on the waveguide and feed horn, respectively, fasten the two together by means of a plurality of screws 45 (or soldered).

To suppress back radiation at the low band (in the direction of the main dish) from the external surface of the horn 11, the open end of the horn is surrounded by a quarter-wave choke (or chokes) 46 comprising a short conductive cylinder 47, concentric with the horn 11, and a shorting ring 48. The inner surface of the cylinder 47 is spaced away from the outer surface of the horn 11 along a length of the horn about equal to a quarter wavelength (at the low band) from the end of the horn, and then the cylinder 47 is shorted to the horn 11 by the ring 48 to form a quarter-wave coaxial choke which suppresses current flow on the outer surface of the horn.

At the high frequency band (for which the free space wavelength is $\lambda_H$), back radiation is suppressed, and equal main beams are obtained in the E and H planes, by cancelling the electric field at the aperture boundary. To achieve this, the ratio of the mode powers $W_{TM11}$ and $W_{TE11}$ must be:

$$\frac{W_{TM11}}{W_{TE11}} = 0.4191 \frac{\lambda_{gTM11}\,\lambda_{gTE11}}{\lambda_H^2} \tag{1}$$

where the guide wavelength of the $TM_{11}$ mode is $$\lambda_{gTM11} = \lambda_H / \sqrt{1 - (3.83/C)^2} \tag{2}$$

The guide wavelength of the $TE_{11}$ mode is $$\lambda_{gTE11} = \lambda_H \sqrt{1 - (1.84/C)^2} \tag{3}$$

and $$C = \pi D1/\lambda_H \tag{4}$$

The relationship between the above mode power ratio, the diameter D1 at the large end of the conical section 42, and the half flare angle $\beta$ (in degrees) of the conical section 42 is known to be given by the following equation:

$$\frac{W_{TM11}}{W_{TE11}} = 2.11 \times 10^{-4} \left(\frac{D1 \cdot \beta}{\lambda_H}\right)^2 \frac{\lambda_{gTM11}\lambda_{gTE11}}{\lambda_H^2} \tag{5}$$

Equating equations (1) and (5) yields:

$$2.11 \times 10^{-4} \left(\frac{D1 \cdot \beta}{\lambda_H}\right)^2 = 0.4191 \tag{6}$$

To produce approximately equal E and H patterns in the low frequency band, the diameter D1 is made about equal to one wavelength, $\lambda_L$, at the midband frequency of the low band, i.e.:

$$D1 = \lambda_L \tag{7}$$

Thus, equation (6) becomes:

$$2.11 \times 10^{-4} \frac{\lambda_L \beta^2}{\lambda_H} = 0.4191 \tag{8}$$

Equation (5) can then be solved for $\beta$:

$$\beta = (44.57) \cdot \frac{\lambda_H}{\lambda_L}, \text{ in degrees} \tag{9}$$

This value of $\beta$ results, at the high band, in cancellation of the electric field at the aperture boundary, which in turn results in approximately equal E and H patterns of the main beam radiated from the horn in the high frequency band.

To ensure that the $TM_{11}$ mode is generated at the junction between the cylindrical section 40 and the conical section 42, the diameter D1 must be such that the value of C, which is defined by equation (4) as $\pi D1/\lambda_H$, is above the Eigen value of 3.83 for the $TM_{11}$ mode in the high frequency band. To ensure that *only* the $TM_{11}$ higher order mode is generated, the diameter D1 must be such that the value of C is below the Eigen value of 5.33 for the $TE_{12}$ mode in the high frequency band, and concentricity of sections 40, 41 and 42 must be maintained. Thus, the value of C must be within the range of from about 3.83 to about 5.33. The symmetry of the cylindrical sections 40 and 41 and of the conical section 42 ensure that the other higher order modes ($TM_{01}$ and $TE_{21}$ which can also propagate for C values greater than 3.83) will not be excited. Since D1 is selected to be equal to one wavelength $\lambda_L$ for the low frequency band, equation (4) gives:

$$C = \frac{\pi\lambda_L}{\lambda_H} \tag{10}$$

and, therefore, the ratio $\lambda_L/\lambda_H$ must be within the range of from about $3.83/\pi$ to about $5.33/\pi$, which is 1.22 to 1.61.

Thus, the two frequency bands must be selected to satisfy the above criteria. One suitable pair of frequency bands are 4GHz and 6GHz, because $\lambda_L$ and D1 are 2.953 inches, $\lambda_H$ is 1.969 inches, and $\lambda_L/\lambda_H$ is 1.5. This value of the ratio $\lambda_L/\lambda_H$ is, of course, within the prescribed range of 1.22 to 1.61.

If desired, a flared corrugated feed horn may be used in place of the dual mode smooth-wall horn in the illustrative embodiment of FIG. 3 (e.g., a flare angle of 45° relative to the axis of the paraboloid of the main reflector could be used). A flared corrugated feed horn provides about the same horizontal plane performance (though having more pattern symmetry) when substituted for the feed horn of FIG. 3, but is significantly more expensive than the feed horn of FIG. 3. The corrugated portions of a flared corrugated feed horn are on the inside of the feed horn. Therefore, for the same inside diameter as the feed horn of FIG. 3, the flared feed horn requires a greater outside diameter. As a result, the flared corrugated feed horn also casts a larger shadow on the main reflector, thereby requiring an increase in the subreflector size and resulting in higher blockage and higher side lobes. It will be appreciated, therefore, that the particular feed horn used in the antenna of FIG. 1 depends on the desired combination of cost and performance characteristics of the antenna.

In one hypothetical example, a paraboloidal main reflector with a diameter of 10 feet is utilized with a focal length-to-diameter ratio of 0.4. The subreflector is 18 inches in diameter. The length L1 of the subreflector shield is 6.302 inches, and the length L2 of the main reflector shield is 41.0 inches. The feed horn is of the type shown in FIG. 3, with an inner diameter of 2.125 inches in its smaller cylindrical section 41 and 2.810 inches in its larger cylindrical section 40. The conical section 42 connecting the two cylindrical sections has a half-flare angle of 30° with respect to the axis of the feed horn. The axial length of the conical section is 0.593 inches. The lengths of the two cylindrical sections 41 and 40 are 1.0 inches and 4.531 inches, respectively, and the mouth of the feed horn is located 24.89 inches from a plane defined by the periphery of the main reflector. With an antenna dimensioned as set out above, the angles $\theta_1$, $\theta_2$ and $\theta_3$ are 55°, 80° and 75°, respectively. The axial length L2 of the main reflector shield is chosen such that the angle $\theta_3$ is less than $\theta_2$. This creates a radial overlap of the two shields 30 and 32 to insure that all of the horn spillover radiation is intercepted by either the main reflector shield 32 or the subreflector shield 30.

Figure 4:
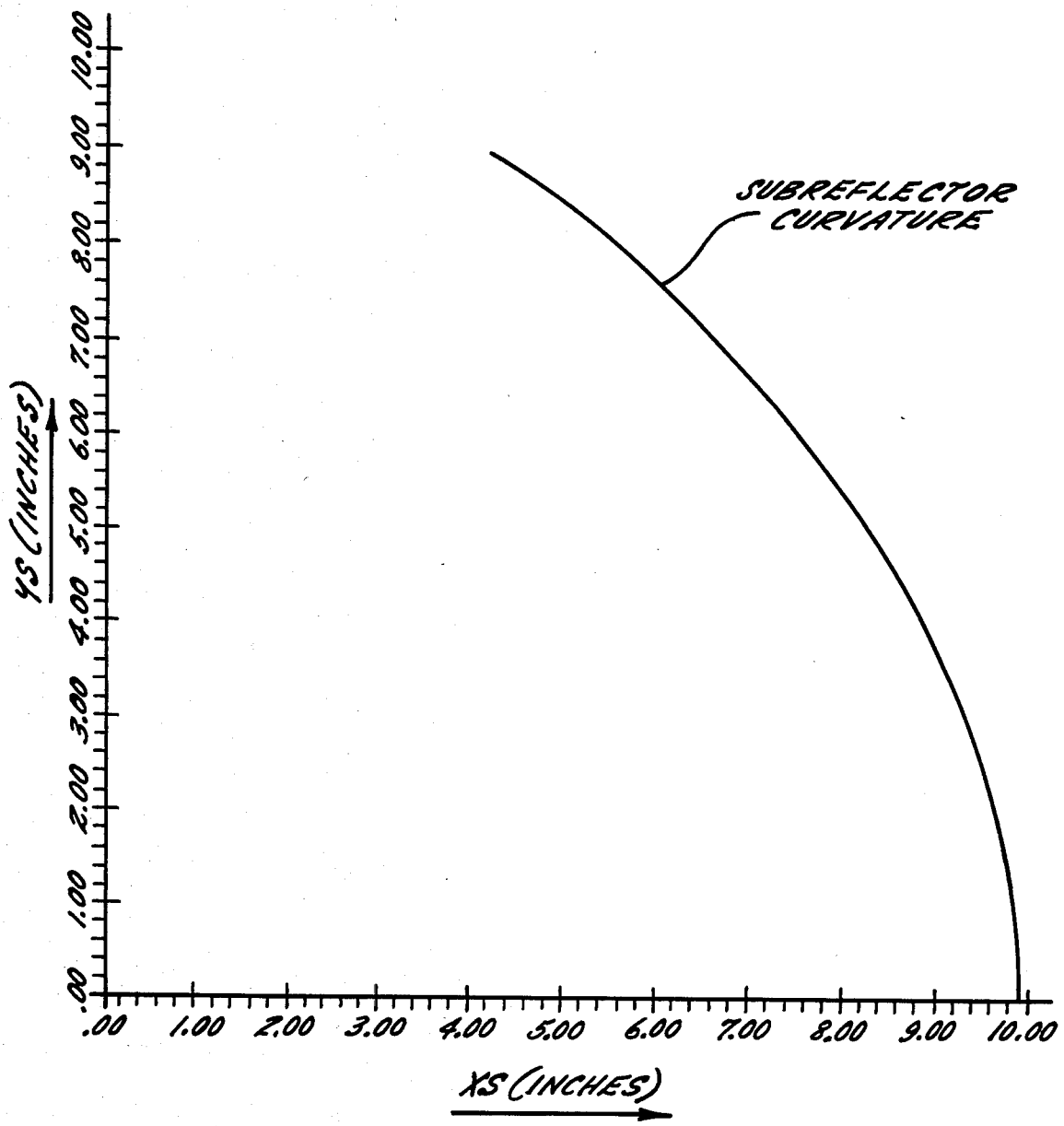
FIG. 4 is a Cartesian coordinate plot of the curve for the subreflector surface for an 18-inch diameter subreflector.

Referring to FIG. 4, a preferred surface curvature of the subreflector 13 for the working example described above is shown by way of a Cartesian coordinate graph. The origin of the Cartesian coordinate system is virtually coincident with the common focal point F of the main reflector and the subreflector, and the measured points are taken along a diameter of the subreflector. The surface curvature describes an arc which is approximately, though not exactly, elliptic.

Figure 5A:
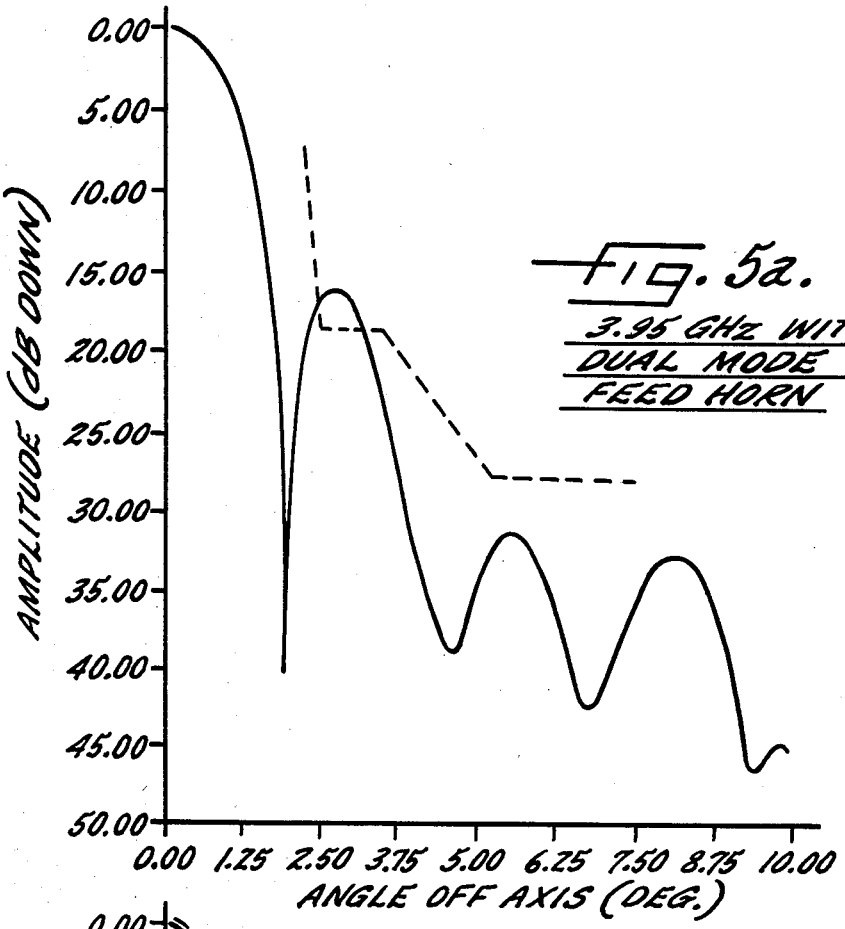
FIGS. 5*a* and 5*b* are radiation patterns from 0° to 10° off axis, at 3.95 GHz and 6.175 GHz, respectively, for an antenna according to the invention utilizing the feed horn shown in FIG. 3.
Figure 5B:
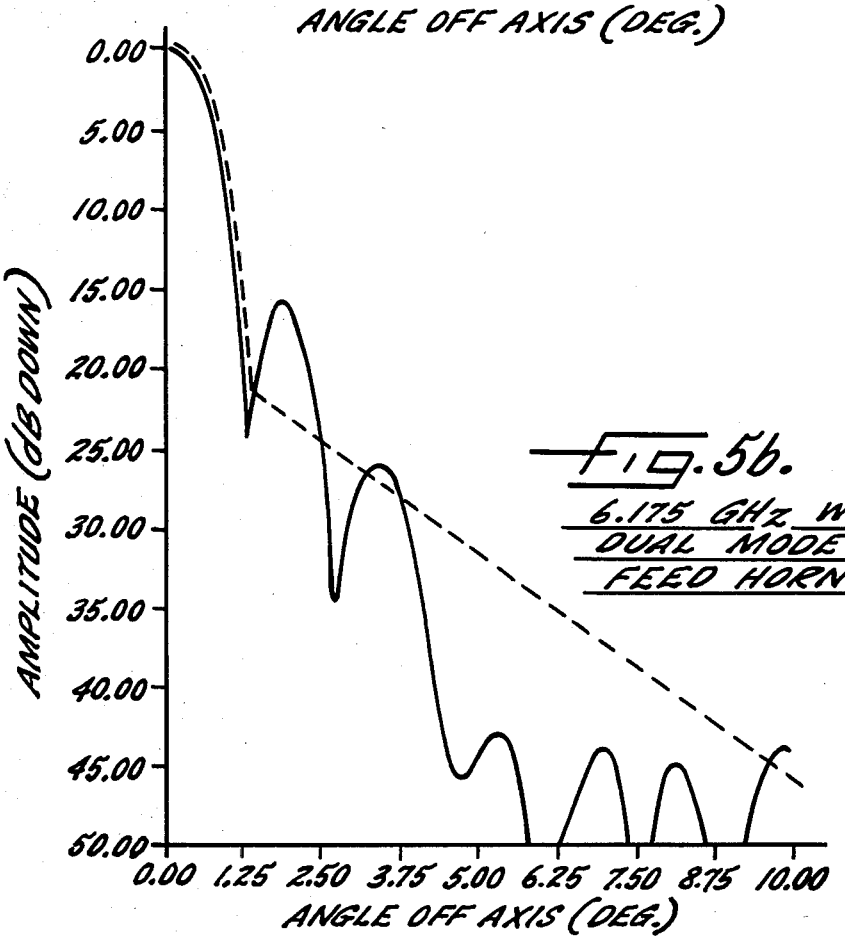

The hypothetical example described above is predicted to produce a power pattern as shown in FIG. 5*a* at 3.95 GHz. The power pattern for the same antenna at 6.175 GHz is shown in FIG. 5*b*. The power patterns in FIGS. 5*a* and 5*b* represent amplitude in decibels along an arc length of a circle whose center is coincident with the position of the antenna.

For comparison, FIGS. 5*a* and 5*b* also show in dashed lines typical envelopes of the power patterns (so-called RPE's, or radiation pattern envelopes) for a presently commercially available antenna. As can be easily seen, the side lobes in the region between 3° and 10° off axis are considerably lower than those predicted for an antenna constructed in accordance with the invention.

Figure 7A:
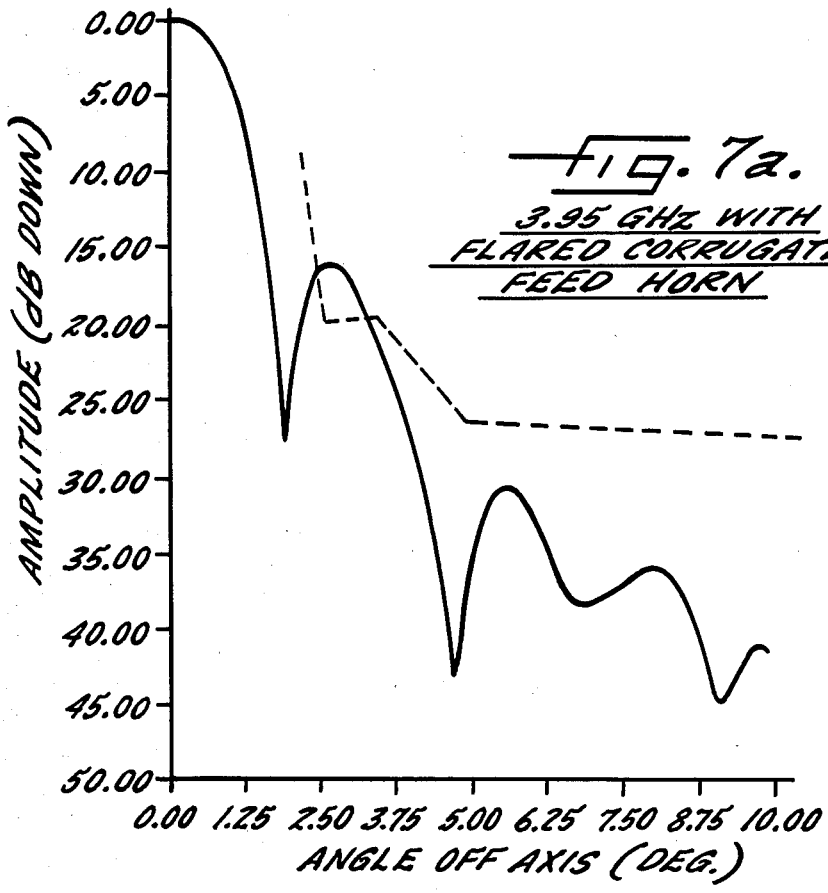
FIGS. 7*a* and 7*b* are radiation patterns from 0° to 10° off axis, at 3.95 GHz and 6.175 GHz, respectively, for an antenna according to the invention utilizing a flared corrugated feed horn.
Figure 7B:
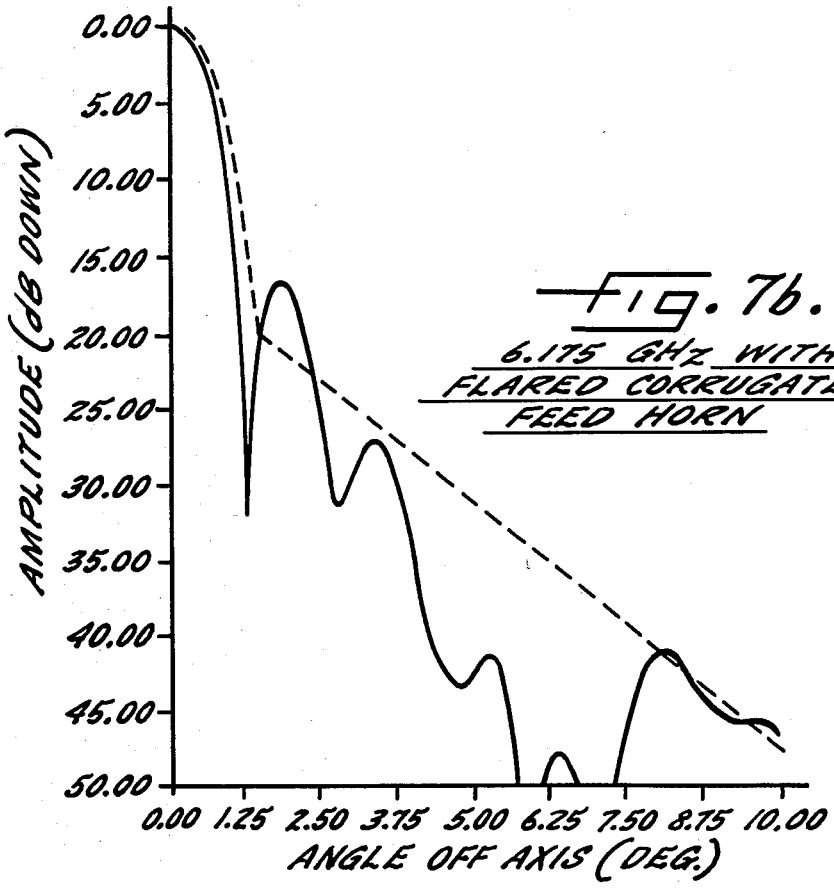

Replacing the FIG. 3 feed horn in the hypothetical example with an equivalent flared corrugated feed horn is predicted to result in the RPE's shown in FIGS. 7*a* and 7*b*. The response at 3.95 GHz is shown in FIG. 7*a*. The response at 6.175 GHz is shown in FIG. 7*b*.

For comparison, FIGS. 7*a* and 7*b* also show in dashed lines typical RPE's for a presently commercially available antenna. As can be seen from an inspection of FIGS. 7*a* and 7*b*, the antenna of the invention with a flared corrugated feed horn displays predicted RPE's which are comparable to the predicted RPE's of FIGS. 5*a* and 5*b* in the side lobe region between 5° and 10°.

Figure 6A:
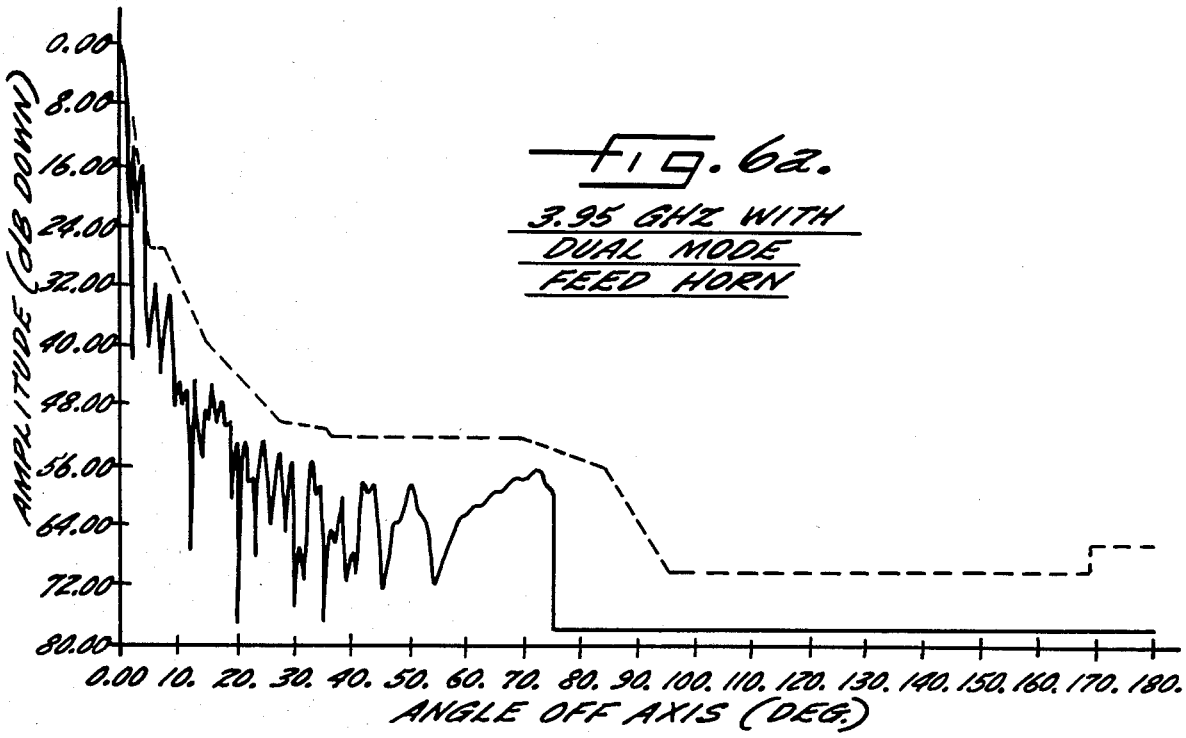
FIGS. 6*a* and 6*b* are radiation patterns from 0° to 180° off axis, at 3.95 and 6.175 GHz, respectively, for an antenna according to the invention utilizing the feed horn shown in FIG. 3.
Figure 6B:
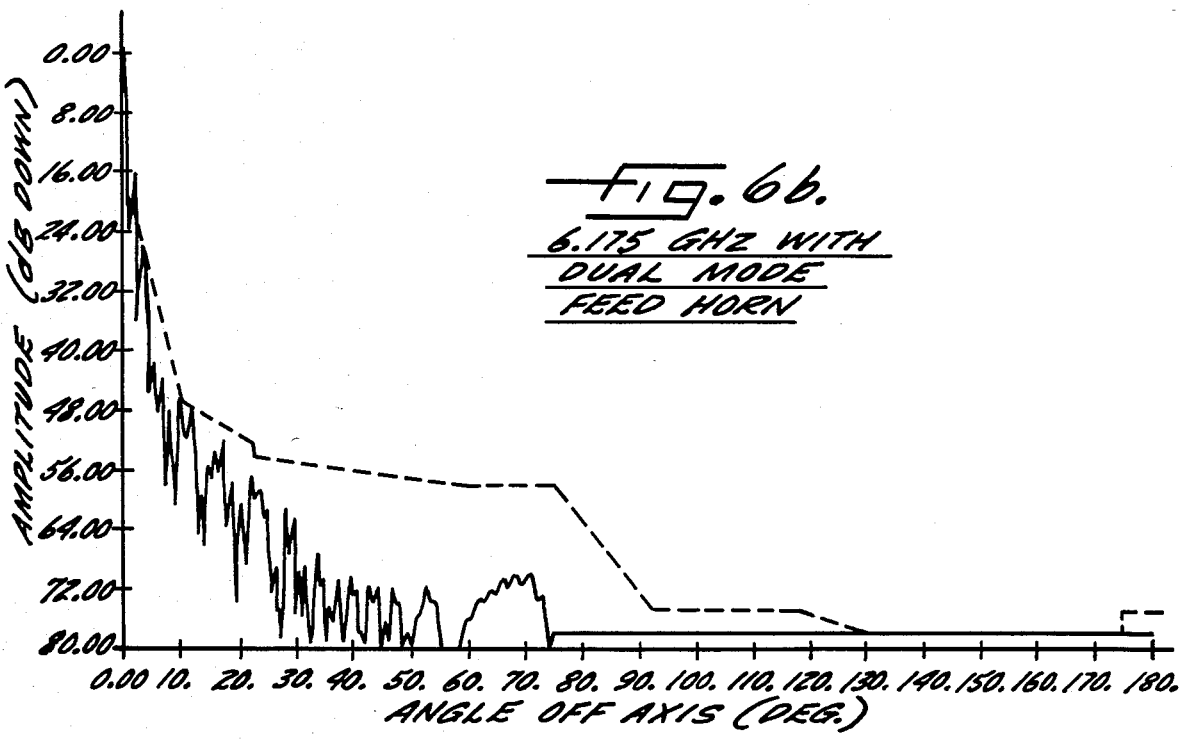
Figure 8A:
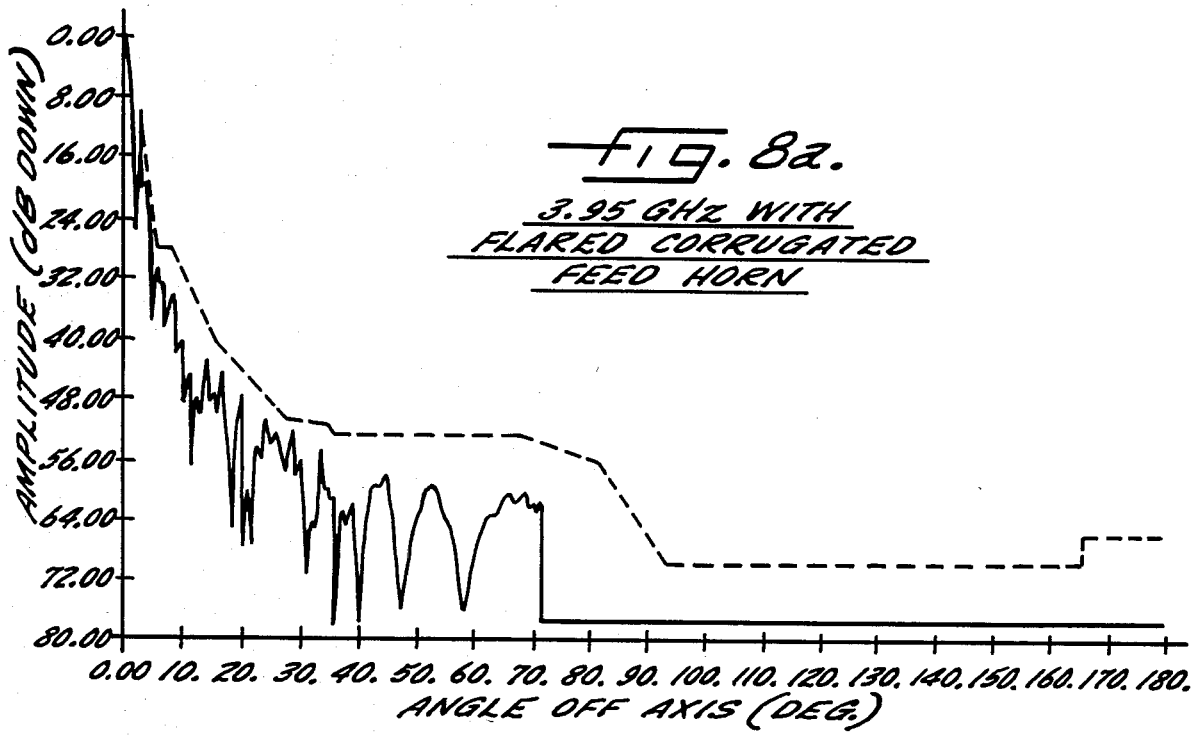
FIGS. 8*a* and 8*b* are radiation patterns from 0° to 180° off axis, at 3.95 and 6.175 GHz, respectively, for an antenna according to the invention utilizing a flared corrugated feed horn.
Figure 8B:
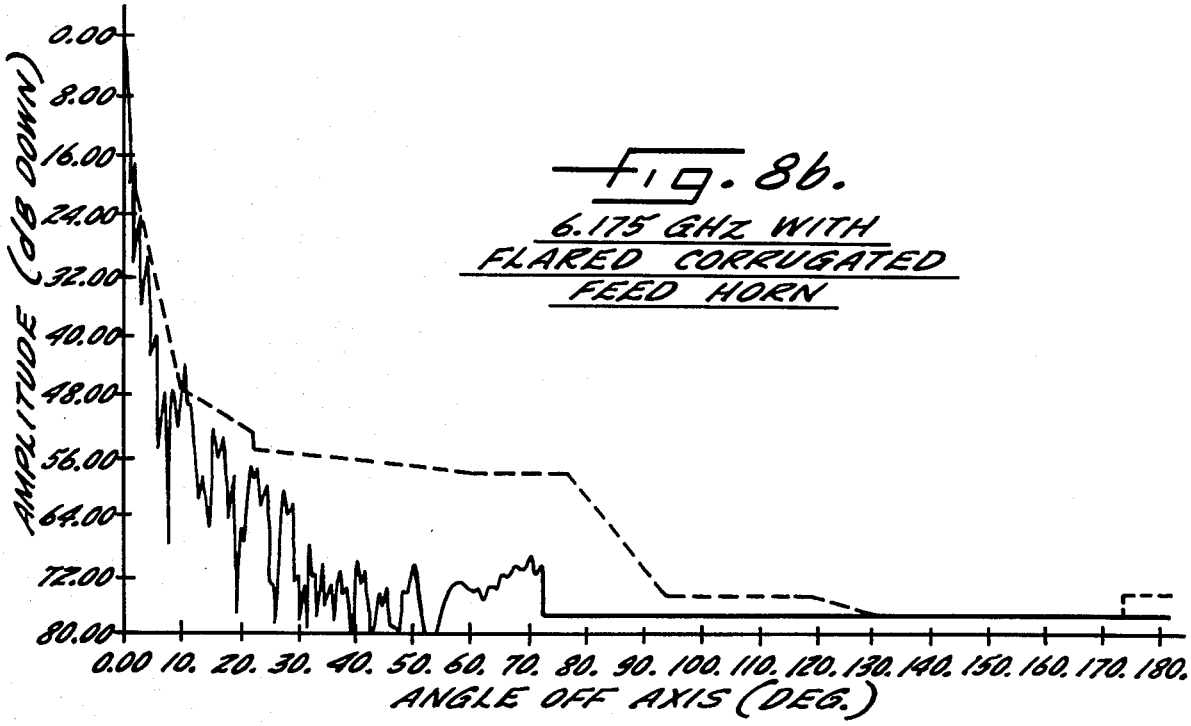

Both working antenna constructions (i.e. with either the FIG. 3 feed horn or the flared corrugated feed horn) exhibit side lobes in the region between 10° and 180° off axis which are consistently lower than side lobes in the same region for prior art antennas. This is readily apparent from the predicted RPE's shown in FIGS. 6*a* and 6*b* (for the antenna with the horn of FIG. 3) and FIGS. 8*a* and 8*b* (for the antenna with the flared corrugated horn).

In summary, it will be appreciated from the foregoing that the dual-reflector microwave antenna according to the invention utilizes a small diameter feed horn and shielded subreflector to achieve a good radiation pattern envelope in the region between 3° and 10° off axis, and subreflector and main reflector shields to achieve a superior radiation pattern in the region between 10° and 180° off axis. In addition, this antenna minimizes side lobes caused by spillover and diffraction while maintaining good gain performance, and the antenna can be efficiently and economically produced at a relatively low cost. This antenna minimizes the length of the main reflector shield, thereby minimizing the total antenna shield surface area. Also, this type of antenna is capable of satisfying the latest RPE specification set by the U.S. Federal Communication Commission for earth station antennas.

We claim as our invention:

1. A microwave antenna comprising the combination of:

a paraboloidal main reflector having an axis and a focal point F;

a subreflector forming a surface of revolution about the axis of said main reflector and having a focal point between said main reflector and said subreflector and substantially coincident with the focal point of said main reflector; a feed horn extending along the axis of said main reflector for transmitting microwave radiation to, and receiving microwave radiation from, said subreflector along a feed horn beam; and a first shield extending from the periphery of said subreflector toward said main reflector, parallel to the axis of the main reflector, for reducing side lobe levels, said first shield terminating outside of the beam passing between the subreflector and the main reflector, a second shield extending from the periphery of said main reflector and parallel to the axis of the main reflector, said first shield intercepting that portion of the feed horn beam which is not intercepted by either said subreflector or said second shield.

2. A microwave antenna as set forth in claim 1 wherein said first shield has outer and inner surfaces which are substantially parallel to said axis, and said inner surface of said first shield is lined with radiation absorbing material.

3. A microwave antenna as set forth in claim 1 wherein the angle $\theta_3$, measured from said axis to a line from the center of the open end of the feed horn to the edge of said second shield farthest away from the main reflector, is less than or equal to the angle $\theta_2$, measured from said axis to a line from the center of the open end of the feed horn to the edge of said first shield closest to the main reflector.

4. A microwave antenna as set forth in claim 1 wherein said subreflector and said first shield form a subreflector-shield assembly, and said first shield significantly reduces diffraction of radiation at the periphery of the subreflector-shield assembly.

5. A microwave antenna as set forth in claim 1 wherein said feed horn has an inside diameter which is no greater than one wavelength at the midband frequency of the lowest frequency band of signals transmitted from or received by said antenna.

* * * * *